US008315397B2

(12) United States Patent
Obata et al.

(10) Patent No.: US 8,315,397 B2
(45) Date of Patent: Nov. 20, 2012

(54) MICROPHONE DEVICE AND PORTABLE RECORDER COMPRISING SAME

(75) Inventors: Yasushi Obata, Osaka (JP); Hitoshi Miyamoto, Osaka (JP); Hiroyoshi Sato, Osaka (JP); Shinya Uchida, Osaka (JP)

(73) Assignee: SANYO Electric Co., Ltd., Moriguchi-Shi (JP)

( * ) Notice: Subject to any disclaimer, the term of this patent is extended or adjusted under 35 U.S.C. 154(b) by 465 days.

(21) Appl. No.: 12/612,015

(22) Filed: Nov. 4, 2009

(65) Prior Publication Data

US 2010/0111326 A1 May 6, 2010

(30) Foreign Application Priority Data

Nov. 5, 2008 (JP) ..... 2008-284405

(51) Int. Cl.
*H04R 5/00* (2006.01)

(52) U.S. Cl. ..... 381/26; 381/27; 381/356; 381/365

(58) Field of Classification Search ..... 381/26–27, 381/92, 170, 355–358
See application file for complete search history.

(56) References Cited

U.S. PATENT DOCUMENTS 4,628,525 A * 12/1986 Iwahara et al. ..... 381/26
5,073,936 A * 12/1991 Gorike et al. ..... 381/26
6,507,659 B1 * 1/2003 Iredale et al. ..... 381/26
6,614,911 B1 * 9/2003 Watson et al. ..... 381/86
2008/0310649 A1 * 12/2008 Yamada ..... 381/92

FOREIGN PATENT DOCUMENTS

JP 2004254074 9/2004
JP 2007043510 2/2007

OTHER PUBLICATIONS http://www.sony.jp/pcm-recorder/products/PCM-D1/freature_1.html; dated Oct. 28, 2009; English summary of underlined relevant portions is included.
http://www.sony.jp/pcm-recorder/products/PCM-D50/feature_1.html; dated Oct. 28, 2009; English summary of underlined relevant portions is included.

* cited by examiner

*Primary Examiner* — Curtis Kuntz
*Assistant Examiner* — Ryan Robinson
(74) *Attorney, Agent, or Firm* — NDQ&M Watchstone LLP

(57) ABSTRACT

A first microphone device according to the present invention comprises a pair of directional microphones with high directivity in a sound collecting direction, a pair of nondirectional microphones with low directivity in the sound collecting direction, and a casing accommodating the pair of directional microphones and the pair of nondirectional microphones. The pair of nondirectional microphones is arranged so that sound collecting directions thereof are outward from both side surface walls of the casing, while the pair of directional microphones is arranged so that sound collecting directions thereof are outward from a front surface wall of the casing and intersect each other in vicinity of the front surface wall. All or a part of the pair of directional microphones is accommodated in a space sandwiched by the pair of nondirectional microphones.

4 Claims, 4 Drawing Sheets

MICROPHONE DEVICE AND PORTABLE RECORDER COMPRISING SAME

The application Number 2008-284405, upon which this patent application is based, is hereby incorporated by reference.

BACKGROUND OF THE INVENTION

1. Field of the Invention

The present invention relates to microphone devices and a portable recorder comprising same.

2. Description of Related Art

Conventionally, a portable recorder comprises a recorder main body and a microphone device for obtaining an audio signal to be recorded on the recorder main body. As the microphone device, known are ones comprising a nondirectional microphone with low directivity in a sound collecting direction, a directional microphone with high directivity in the sound collecting direction or the like. The nondirectional microphone can collect sound from the periphery, while the directional microphone can collect sound from a sound collection object in a focused manner.

It has been suggested to provide a plurality of directional microphones to the microphone device in order to obtain sound from the sound collection object with high sound quality. For example, it has been suggested to provide a pair of directional microphones in an inverted V-shape in the portable recorder to form an XY directional stereo microphone. This allows the pair of directional microphones to capture sound from the sound collection object at the same phase and sensitivity, resulting in obtaining sound from the sound collection object with high sound quality.

However, it is problematic because in the case where the portable recorder described above records sound from the periphery while being arranged on a desk such as in the case of a conference or a group interview, sound from the periphery cannot be recorded with an optimal sound quality.

A possible way to solve the above discussed problem is to provide a pair of nondirectional microphones to the microphone device in addition to the pair of directional microphones. However, installation of these four microphones in the microphone device results in an increase in size of the microphone device.

SUMMARY OF THE INVENTION

In view of above described problem, an object of the present invention is to provide a microphone device which is capable of collecting both sound from a sound collection object and sound from the periphery and which is compact, and a portable recorder comprising same.

A first microphone device according to the present invention comprises a pair of directional microphones with high directivity in a sound collecting direction, a pair of nondirectional microphones with low directivity in the sound collecting direction, and a casing accommodating the pair of directional microphones and the pair of nondirectional microphones. The pair of nondirectional microphones is arranged so that sound collecting directions thereof are outward from both side surface walls of the casing, while the pair of directional microphones is arranged so that sound collecting directions thereof are outward from a front surface wall of the casing and intersect each other in vicinity of the front surface wall. All or a part of the pair of directional microphones is accommodated in a space sandwiched by the pair of nondirectional microphones.

With the microphone device described above, the pair of directional microphones is arranged so that the sound collecting directions thereof intersect each other in vicinity of the front surface wall of the casing, and therefore, the pair of directional microphones can capture sound from a sound collection object at the same phase and sensitivity. Thus, the directional microphones can obtain sound from the sound collection object with high sound quality.

In contrast, the pair of nondirectional microphones is arranged so that the sound collecting directions thereof are outward from both the side surface walls of the casing, and therefore, the pair of nondirectional microphones can collect sound from the periphery of the microphone device. Accordingly, even in the case where a portable recorder records sound from the periphery while being arranged on a desk such as in the case of a conference or a group interview, sound from the periphery can be obtained with an optimal sound quality.

In addition, since all or a part of the pair of directional microphones is accommodated in the space sandwiched by the pair of nondirectional microphones, the pair of directional microphones and the pair of nondirectional microphones are compactly accommodated in the casing.

A second microphone device according to the present invention is the first microphone device described above, wherein each of the pair of directional microphones includes a first sound collecting surface and a second sound collecting surface facing opposite to each other, and the first sound collecting surface faces a first sound collecting hole provided to the front surface wall of the casing, while the second sound collecting surface faces a second sound collecting hole provided to a rear surface wall of the casing.

A third microphone device according to the present invention is the second microphone device described above, wherein the casing is provided therein with a sound collecting space extending from the second sound collecting hole of the casing to the second sound collecting surface of each of the pair of directional microphones.

According to the second and third microphone devices described above, regarding the directional microphone, sound from the side and sound from the rear included in sound collected on the first sound collecting surface is negated by sound from the side and sound from the rear collected on the second sound collecting surface, thereby obtaining only sound from the sound collection direction with high sound quality.

A fourth microphone device according to the present invention is any one of the first to third microphone devices described above, wherein the casing is provided therein with a holder comprising a first holder part retaining the pair of directional microphones and a pair of second holder parts retaining the pair of nondirectional microphones, and the first holder part is interposed between the pair of second holder parts. The first holder part includes a top surface wall and a bottom surface wall which are elastically deformable, and each of the top surface wall and the bottom surface wall is provided with a pair of rectangular openings arranged in a V-shape, with the pair of rectangular openings in the top surface wall and the pair of rectangular openings in the bottom surface wall facing each other.

According to the fourth microphone device described above, the top surface wall and the bottom surface wall are elastically deformed so that the pair of directional microphones is fitted in the pair of rectangular openings arranged in a V-shape, and the pair of directional microphones is thereby retained by the holder with the sound collecting directions thereof intersecting each other in vicinity of the front surface wall of the casing.

Also, since the first holder part is interposed between the pair of second holder parts, by retaining the pair of nondirectional microphones by means of the pair of second holder parts, all or a part of the pair of directional microphones retained by the first holder part is accommodated in the space sandwiched by the pair of nondirectional microphones. Thus, by using the holder, the pair of directional microphones and the pair of nondirectional microphones can be easily arranged at predetermined positions in the casing.

A portable recorder according to the present invention comprises any of the first to fourth microphone devices described above and a recorder main body recording an audio signal obtained by the microphone device.

DETAILED DESCRIPTION OF THE PREFERRED EMBODIMENT

A preferred embodiment of the present invention is described in detail below with reference to the drawings.

Figure 1:
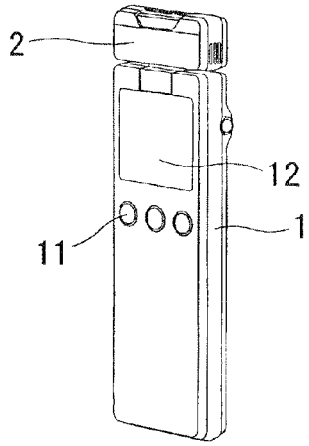
FIG. 1 is a perspective view of a portable recorder according to an embodiment of the present invention.
Figure 2:
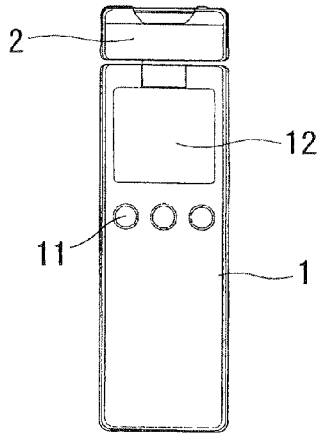
FIG. 2 is a plane view of the portable recorder taken from a display screen side.
Figure 3:
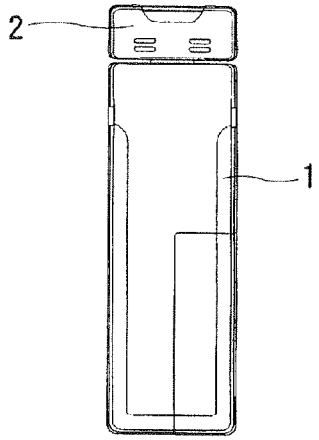
FIG. 3 is a plane view of the portable recorder taken from an opposite side to the display screen side.

As shown in FIGS. 1 to 3, a portable recorder according to an embodiment of the present invention comprises a recorder main body 1 and a microphone device 2. The recorder main body 1 records a sound signal obtained by the microphone device 2, and is provided with a button 11 for operating to start or stop recording sound, a display screen 12 for displaying operation condition of the recorder main body 1, sound recording time, etc. and the like.

Figure 4:
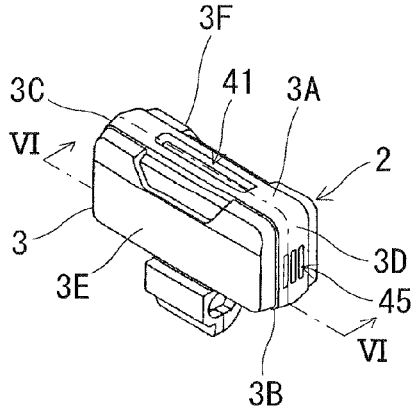
FIG. 4 is a perspective view of a microphone device taken from a front surface wall side.

As shown in FIG. 4, the microphone device 2 includes a casing 3. And as shows in FIG. 5, the casing 3 accommodates therein a pair of directional microphones 21, 22 and a pair of nondirectional microphones 23, 24.

The casing 3 comprises a first casing part 31 integrally formed by a front surface wall 3A, a rear surface wall 3B, and both side surface walls 3C, 3D; a second casing part 32 including a top surface wall 3E; and a third casing part 33 including a bottom surface wall 3F.

To the first casing part 31, the second casing part 32 is attached from above and the third casing part 33 is attached from below, thereby forming the casing 3. In the casing 3, defined is a space for accommodating the pair of directional microphones 21, 22 and the pair of nondirectional microphones 23, 24.

Figure 6:
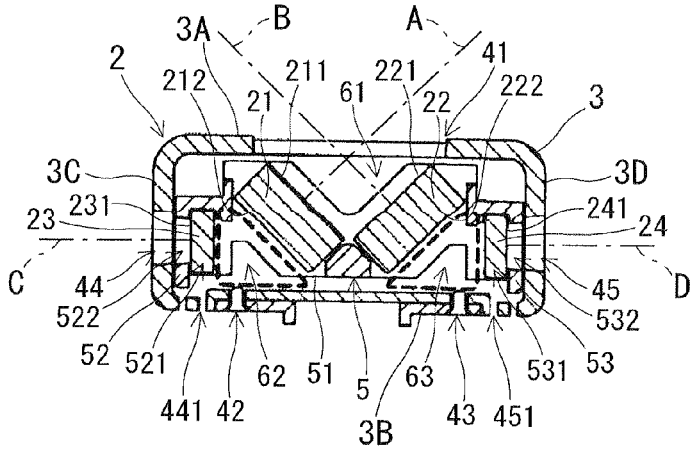
FIG. 6 is a cross-sectional view taken along a VI-VI line shown in FIG. 4.

The nondirectional microphones 23, 24 have low directivities in sound collecting directions C, D shown in FIG. 6 respectively, and are arranged in the casing 3 so that the sound collecting directions C, D thereof face outward from the side surface walls 3C, 3D.

In contrast, the directional microphones 21, 22 have high directivities in sound collecting directions A, B shown in FIG. 6 respectively. In particular, the directional microphone 21 includes a first sound collecting surface 211 and a second sound collecting surface 212 facing opposite to each other. Sound from the side and sound from the rear included in sound collected on the first sound collecting surface 211 is negated by sound from the side and sound from the rear collected on the second sound collecting surface 212, thereby obtaining only sound from the front (the sound collecting direction A) with high sound quality. Likewise, the directional microphone 22 includes a first sound collecting surface 221 and a second sound collecting surface 222 facing opposite to each other. Sound from the side and sound from the rear included in sound collected on the first sound collecting surface 221 is negated by sound from the side and sound from the rear collected on the second sound collecting surface 222, thereby obtaining only sound from the front (the sound collecting direction B) with high sound quality.

As shown in FIG. 6, a part of the pair of directional microphones 21, 22 is accommodated in a space sandwiched by the pair of nondirectional microphones 23, 24. In addition, the pair of directional microphones 21, 22 is arranged in the casing 3 so that the sound collecting directions A, B thereof are outward from the front surface wall 3A of the casing 3 and intersect each other in vicinity of the front surface wall 3A. In other words, the pair of directional microphones 21, 22 forms an XY directional stereo microphone.

Figure 7:
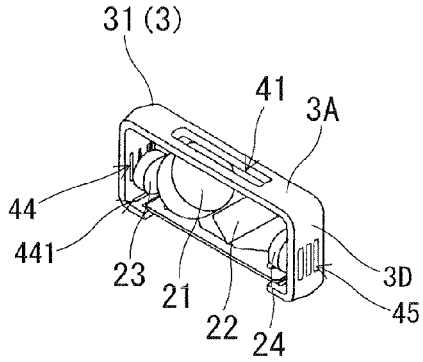
FIG. 7 is a perspective view for explaining an arrangement of a pair of directional microphones and a pair of nondirectional microphones.

In FIG. 7, a location relation between the pair of directional microphones 21, 22 and the pair of nondirectional microphones 23, 24 is shown by a perspective view.

Figure 5:
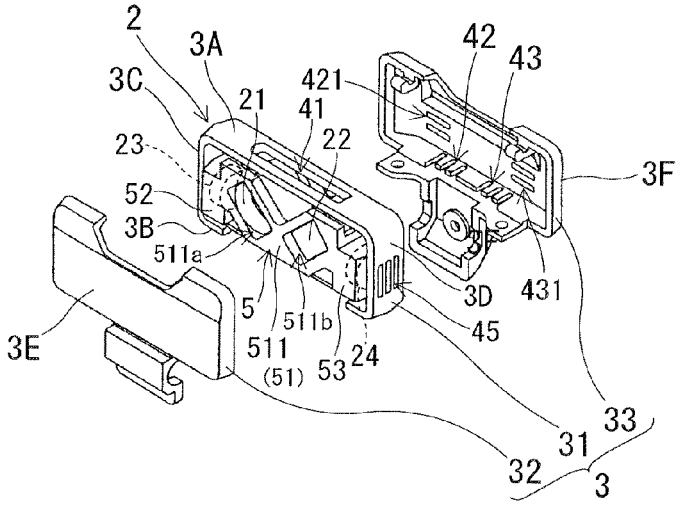
FIG. 5 is an exploded perspective view of the microphone device taken from the front surface wall side.

In the casing 3, provided is a holder 5 retaining the pair of directional microphones 21, 22 and the pair of nondirectional microphones 23, 24 as shown in FIG. 5. The holder 5 comprises a first holder part 51 retaining the pair of directional microphones 21, 22, and a pair of second holder parts 52, 53 retaining the pair of nondirectional microphones 23, 24. The first holder part 51 is interposed between the pair of second holder parts 52, 53.

Figure 9:
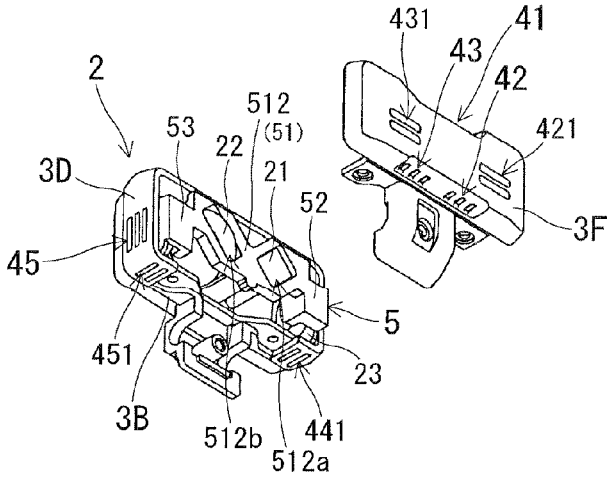
FIG. 9 is an exploded perspective view of the microphone device taken from the rear surface wall side.

As shown in FIGS. 5 and 9, the first holder part 51 includes a top surface wall 511 and a bottom surface wall 512 which are elastically deformable. The top surface wall 511 is provided with a pair of rectangular openings 511*a*, 511*b* arranged in a V-shape, while the bottom surface wall 512 is provided with a pair of rectangular openings 512*a*, 512*b* arranged in a V-shape.

The rectangular opening 511*a* defined in the top surface wall 511 corresponds to the rectangular opening 512*a* defined in the bottom surface wall 512, and these rectangular openings 511*a* and 512*a* are arranged so as to face each other. Also, the rectangular opening 511*b* defined in the top surface wall 511 corresponds to the rectangular opening 512*b* defined in the bottom surface wall 512, and these rectangular openings 511*b* and 512*b* are arranged so as to face each other.

As shown in FIG. 6, the second holder parts 52, 53 are respectively provided with accommodation rooms 521, 531 for accommodating the pair of nondirectional microphones 23, 24, and are also respectively provided with through-holes 522, 532 communicating with the accommodation rooms 521, 531. The through-holes 522, 532 are defined at positions facing the side surface walls 3C, 3D of the casing 3 respectively when the holder 5 is arranged in the casing 3.

In order for the holder 5 to retain the pair of directional microphones 21, 22, the top surface wall 511 and the bottom surface wall 512 are elastically deformed so that the directional microphone 21 is fitted in the rectangular opening 511*a* and the rectangular opening 512*a* corresponding to each other, while the directional microphone 22 is fitted in the rectangular opening 511*b* and the rectangular opening 512*b* corresponding to each other. The pair of directional microphones 21, 22 is thereby retained by the holder 5 with the sound collecting directions A, B thereof intersecting each other in vicinity of the front surface wall 3A of the casing 3 (see FIG. 6).

In contrast, In order for the holder 5 to retain the pair of nondirectional microphones 23, 24, the nondirectional microphones 23, 24 are respectively accommodated in the accommodation rooms 521, 531 defined in the pair of second holder parts 52, 53. Here, the pair of nondirectional microphones 23, 24 is arranged so that sound collecting surfaces 231, 241 thereof are seeable through the through-holes 522, 532 defined in the pair of second holder parts 52, 53 (see FIG. 6).

Since the first holder part 51 of the holder 5 is interposed between the pair of second holder parts 52, 53 of the holder 5, a part of the pair of directional microphones 21, 22 retained by the first holder part 51 is accommodated in the space sandwiched by the pair of nondirectional microphones 23, 24.

Thus, by using the holder 5, the pair of directional microphones 21, 22 and the pair of nondirectional microphones 23, 24 can be easily arranged at predetermined positions in the casing 3.

By arranging the pair of directional microphones 21, 22 as described above, in the casing 3, a first sound collecting space 61 is defined along both the first sound collecting surfaces 211, 221, and a second sound collecting spaces 62, 63 are defined along the second sound collecting surfaces 212, 222 respectively, as shown in FIG. 6.

As shown in FIGS. 4 and 6, the front surface wall 3A of the casing 3 is provided with a first sound collecting hole 41 allowing the first sound collecting space 61 to communicate with the outside, and the first sound collecting surfaces 211, 221 of the pair of directional microphones 21, 22 face the first sound collecting hole 41. Accordingly, sound entering the portable recorder from the first sound collecting hole 41 passes through the first sound collecting space 61 to reach the first sound collecting surfaces 211, 221 of the directional microphones 21, 22.

Figure 8:
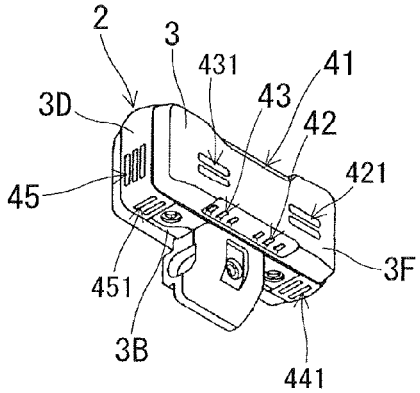
FIG. 8 is a perspective view of the microphone device taken from a rear surface wall side.

As shown in FIGS. 6 and 8, the rear surface wall 3B of the casing 3 is provided with second sound collecting holes 42, 43 allowing the second sound collecting spaces 62, 63 to communicate with the outside respectively, and the second sound collecting surfaces 212, 222 of the pair of directional microphones 21, 22 face the second sound collecting holes 42, 43 respectively. Accordingly, sounds entering the portable recorder respectively from the second sound collecting holes 42, 43 pass through the second sound collecting spaces 62, 63 to reach the second sound collecting surfaces 212, 222 of the directional microphones 21, 22.

Further, as shown in FIGS. 6 and 8, the side surface walls 3C, 3D of the casing 3 are provided with third sound collecting holes 44, 45 allowing the accommodation rooms 521, 531 of the second holder parts 52, 53 to communicate with the outside respectively, and the sound collecting surfaces 231, 241 of the pair of nondirectional microphones 23, 24 face the third sound collecting holes 44, 45 respectively. Accordingly, sounds entering the portable recorder respectively from the third sound collecting holes 44, 45 reach the sound collecting surfaces 231, 241 of the nondirectional microphones 23, 24.

As shown in FIG. 8, the bottom surface wall 3F of the casing 3 is provided with sound collecting holes 421, 431 allowing the second sound collecting spaces 62, 63 to communicate with the outside respectively, thereby collecting sound from the side on the second sound collecting surfaces 212, 222 of the pair of directional microphones 21, 22. Therefore, sound from the side is reliably eliminated from sound obtained on the first sound collecting surfaces 211, 221, resulting in higher directivities of the directional microphones 21, 22 in the sound collecting directions A, B.

As shown in FIGS. 6 and 8, the rear surface wall 3B of the casing 3 is provided with sound collecting holes 441, 451 allowing the accommodation rooms 521, 531 of the second holder parts 52, 53 to communicate with the outside respectively. Accordingly, sound from the periphery is likely to gather at the pair of nondirectional microphones 23, 24.

With the microphone device 2 and the portable recorder comprising the microphone device 2 described above, the pair of directional microphones 21, 22 is arranged so that the sound collecting directions A, B thereof intersect each other in vicinity of the front surface wall 3A of the casing 3, and therefore, the pair of directional microphones 21, 22 can capture sound from a sound collection object at the same phase and sensitivity. Thus, sound from the sound collection object can be obtained with high sound quality.

In contrast, the pair of nondirectional microphones 23, is arranged so that the sound collecting directions C, D thereof are outward from the side surface walls 3C, 3D of the casing 3, and therefore, the pair of nondirectional microphones 23, 24 can collect sound from the periphery of the microphone device 2. Therefore, even in the case where the portable recorder records sound from the periphery while being arranged on a desk such as in the case of a conference or a group interview, sound from the periphery can be obtained with an optimal sound quality.

Figure 10:
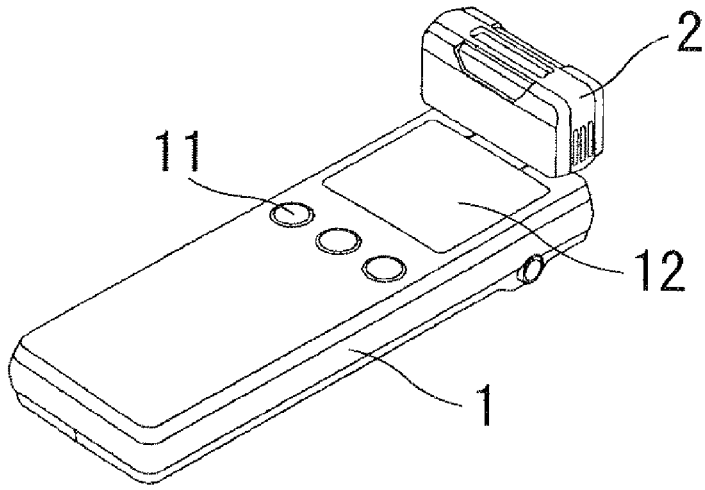
FIG. 10 is a perspective view of the portable recorder showing a configuration thereof while usage.

In the portable recorder according to this embodiment, the microphone device 2 is attached to a fore-end of the recorder main body 1, and the recorder main body 1 and the microphone device 2 are coupled with each other by a hinge. The microphone device 2 is arranged in front of the fore-end of the recorder main body 1 by opening the hinge as shown in FIG. 1, while is arranged above the fore-end of the recorder main body 1 by folding the hinge as shown in FIG. 10.

For example, when the portable recorder records sound from the sound collection object, the microphone device 2 is arranged in front of the fore-end of the recorder main body 1 (FIG. 1). In contrast, in the case where the portable recorder records the sound from the periphery while being arranged on a desk such as in the case of a conference or a group interview, the microphone device 2 is arranged above the fore-end of the recorder main body 1 (FIG. 10).

In this embodiment, a part of the pair of directional microphones 21, 22 is accommodated in the space sandwiched by the pair of nondirectional microphones 23, 24, and therefore, the pair of directional microphones 21, 22 and the pair of nondirectional microphones 23, 24 are compactly accommodated in the casing 3.

The present invention is not limited to the foregoing embodiment in construction but can be modified variously within the technical range set forth in the appended claims. For example, the pair of directional microphones 21, 22 may be arranged so that all of them are accommodated in the space sandwiched by the pair of nondirectional microphones 23, 24.

Also, the position of the sound collection hole defined in the casing 3 is not limited to that in the embodiment described above. For example, the sound collection holes communicating with the second sound collecting spaces 62, 63 may be defined in the top surface wall 3E of the casing 3 (see FIG. 4).

What is claimed is:

1. A microphone device comprising:

a pair of directional microphones with high directivity in a sound collecting direction, a pair of nondirectional microphones with low directivity in the sound collecting direction, and a casing accommodating the pair of directional microphones and the pair of nondirectional microphones, wherein the pair of nondirectional microphones is arranged so that sound collecting directions thereof are outward from both side surface walls of the casing, while the pair of directional microphones is arranged so that sound collecting directions thereof are outward from a front surface wall of the casing and intersect each other in vicinity of the front surface wall, and all or a part of the pair of directional microphones is accommodated in a space sandwiched by the pair of nondirectional microphones;

wherein each of the pair of directional microphones includes a first sound collecting surface and a second sound collecting surface facing opposite to each other, and the first sound collecting surface faces a first sound collecting hole provided to the front surface wall of the casing, while the second sound collecting surface faces a second sound collecting hole provided to a rear surface wall of the casing.

2. The microphone device according to claim 1, wherein the casing is provided therein with a sound collecting space extending from the second sound collecting hole of the casing to the second sound collecting surface of each of the pair of directional microphones.

3. A microphone device comprising:

a pair of directional microphones with high directivity in a sound collecting direction, a pair of nondirectional microphones with low directivity in the sound collecting direction, and a casing accommodating the pair of directional microphones and the pair of nondirectional microphones, wherein the pair of nondirectional microphones is arranged so that sound collecting directions thereof are outward from both side surface walls of the casing, while the pair of directional microphones is arranged so that sound collecting directions thereof are outward from a front surface wall of the casing and intersect each other in vicinity of the front surface wall, and all or a part of the pair of directional microphones is accommodated in a space sandwiched by the pair of nondirectional microphones;

wherein the casing is provided therein with a holder comprising a first holder part retaining the pair of directional microphones and a pair of second holder parts retaining the pair of nondirectional microphones, the first holder part is interposed between the pair of second holder parts, the first holder part includes a top surface wall and a bottom surface wall which are elastically deformable, and each of the top surface wall and the bottom surface wall is provided with a pair of rectangular openings arranged in a V-shape, with the pair of rectangular openings in the top surface wall and the pair of rectangular openings in the bottom surface wall facing each other.

4. A portable recorder comprising the microphone devices according to claim 1 and a recorder main body recording an audio signal obtained by the microphone device.

* * * * *